US006299282B1

(12) United States Patent
Hiramatsu

(10) Patent No.: US 6,299,282 B1
(45) Date of Patent: Oct. 9, 2001

(54) RECORDING APPARATUS

(75) Inventor: Soichi Hiramatsu, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,952

(22) Filed: Mar. 9, 2000

(30) Foreign Application Priority Data

Mar. 25, 1999 (JP) ..... 11-081740

(51) Int. Cl.[7] ..... B41J 23/00; B41J 2/15
(52) U.S. Cl. ..... 347/37; 347/40; 347/43
(58) Field of Search ..... 347/37, 40, 43

(56) References Cited

U.S. PATENT DOCUMENTS

| | | | | |
|---|---|---|---|---|
| 5,151,716 | | 9/1992 | Kanemitsu | 346/140 R |
| 5,742,304 | * | 4/1998 | Richtsmeier et al. | 347/40 |
| 5,914,736 | * | 6/1999 | Tamura | 347/37 |
| 6,045,212 | * | 4/2000 | Ruhe et al. | 347/37 |

FOREIGN PATENT DOCUMENTS

| | | |
|---|---|---|
| 03-246059 | 11/1991 | (JP) . |
| 05-155092 | 6/1993 | (JP) . |
| 06-091896 | 4/1994 | (JP) . |
| 09-248922 | 9/1997 | (JP) . |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A recording apparatus is provided with a carriage capable of traveling with recording heads mounted thereon to record images on a recording medium. The recording apparatus contains a carriage driving system for enabling the carriage to travel at a traveling speed v in a constant speed condition and having a vibration frequency f inherent to the carriage driving system. The recording heads each has a pixel array of recording elements, each of the pixel arrays are arranged parallel to each other and adjacent arrays are arranged at an interval of an integer times v/f. Furthermore, the pixel arrays may be arranged to be at intervals of the integral times of the torque ripple of the carriage driving system.

12 Claims, 7 Drawing Sheets

RECORDING APPARATUS

BACKGROUND OF THE INVENTION

1. Field of the Invention

The present invention relates to a recording apparatus that records images, such as characters, figures, and patterns, on a recording medium.

2. Related Background Art

There has been known conventionally the so-called serial recording apparatus that records on the surface of a recording medium by enabling the carriage that mounts a recording head thereon to travel in the direction orthogonal to the carrying direction of the recording medium. With the serial recording apparatus thus arranged, images are recorded on a recording medium by repeating the recording operations to carry the recording medium and to move the carriage alternately. In general, the carriage travels along the carriage shaft, and a motor is used as the driving power therefor. The driving power of the motor is transmitted to the carriage through a timing belt which is tensioned around the pulley of the motor and partly fixed to the carriage.

In recent years, there have been more demands to the higher image formation, and the materialization of high image quality as well. To meet such demands, a structure is adopted so that images are recorded by use of plural lines of pixel arrays each formed by plural pixels. Then, for example, a color recording apparatus or the like has been proposed with a carriage which is provided with the plural recording heads each using yellow, magenta, cyan, and black, respectively, in a state where these heads are arranged side by side in the traveling direction of the carriage, thus performing color printing by overlaying each of the colors as required.

Here, when the motor is driven as the driving source of carriage movement as described above, the traveling speed of the carriage is subjected to the changes of its speed due to the run-out (eccentricity) of the driving pulley, for example. The changes of carriage speed that may take place in such a manner tend to bring about the unevenness of recording images eventually. For the color recording apparatus or the like which performs the color recording by overlaying each of the colors with the carriage having the four-color heads arranged on it side by side in the traveling direction of the carriage, such recording unevenness is allowed to appear as the deviation of each color in a recording image, and results in the degradation of image quality ultimately.

Of the serial recording apparatuses described above, the ink jet recording apparatus which performs the image recording by discharging ink droplets from the recording heads, in particular, finds it necessary to make the distance between each of the plural recording heads substantially equal to the moving amount of the driving pulley per rotation or integral times such moving amount in order to reduce the degradation of image quality due to the changes of carriage speed. A structure of the kind has been disclosed in the specification of Japanese Patent Application Laid-Open No. 03-246059 and the specification of Japanese Patent Application Laid-Open No. 05-155092, for example. Also, in the specification of Japanese Patent Application Laid-Open No. 06-91896 and the specification of Japanese Patent Application Laid-Open No. 09-248922, it has been disclosed that the timing of ink discharges is made changeable for each of the recording heads in order to correct the changes of carriage speed due to the pulley run-out.

The problems described above are caused by the changes of the carriage speed. Here, the cycle of the speed changes is relatively large, such as almost equivalent to one cycle of the pulley. However, the cycle of the speed changes is relatively small as the component of acceleration. For the conventional ink jet recording apparatus, the unevenness of recorded images and the color deviation may take place due to the positional deviation of the recording heads caused by such changes of the carriage speed at the time of discharging ink. For example, therefore, it may be possible to solve the problems by effectuating the discharge timing appropriately by use of an encoder or the like provided within the traveling range of the carriage.

However, among the factors that may cause the speed changes of the carriage, there are, besides the one described above, those having a relatively small cycle, but relatively large component of acceleration, which are caused by the vibrations due to the gap between the tooth of the timing belt, the torque ripple of the motor, or due to the vibration frequency inherent in the vibrating system of the driving systems as a whole.

The image unevenness and color deviation that may be caused by those factors described above are smaller than those caused by the eccentricity of the pulley or the like. However, the aforesaid vibrations or the like caused by the minute vibrations due to the "play" between the carriage having the recording heads mounted thereon, and the carriage shaft, which may also bring about the image unevenness and color deviation, cannot be prevented by the provision of the structure whereby to make the timing of ink discharges appropriate by use of the encoder or the like.

SUMMARY OF THE INVENTION

With a view to solving the problems discussed above, the present invention is designed. It is an object of the invention to provide a recording apparatus capable of recording images in a high quality by suppressing the image unevenness and color deviations caused by the minute vibrations of the carriage driving system.

It is another object of the invention to provide a recording apparatus capable of suppressing the generation of minute vibrations of the carriage by enabling the phase of positional deviations of each of the pixel arrays to be in agreement with each other as to the recording position on a recording medium, thus preventing the image unevenness and color deviations from being created when overlaying each of the recorded images formed by each of the pixel arrays.

It is still another object of the invention to provide a recording apparatus having a carriage capable of traveling with recording means mounted thereon to record images on a recording medium, which comprises carriage traveling means for enabling the carriage to travel at a traveling speed v in a constant speed condition: the carriage traveling means drives the carriage by a carriage driving system having an inherent vibration frequency f; and a plurality of pixel arrays formed by plural pixels for each of recording means arranged in parallel with each other: each of the pixel arrays themselves adjacent to each other is arranged for the pixel arrays to be at interval of the integral times of the v/f.

It is a further object of the invention to provide a recording apparatus having a carriage capable of traveling with recording means mounted thereon for recording images on a recording medium, which comprises a timing belt for transmitting to said carriage the driving power of a driving source for the carriage to travel: the timing belt is provided with a plurality of tooth portions for transmitting the driving power; and a plurality of pixel arrays formed by plural pixels for each of recording means arranged in parallel with each other: each of the said pixel arrays themselves adjacent to each other is arranged for the pixel arrays to be at interval of the integral times of the tooth portions of the timing belt.

It is still a further object of the invention to provide a recording apparatus having a carriage capable of traveling with recording means mounted thereon for recording images on a recording medium, which comprises a driving source for said carriage to travel: the driving source is provided with torque ripple; and a plurality of pixel arrays formed by plural pixels for each of recording means arranged in parallel with each other: each of said pixel arrays themselves adjacent to each other is arranged for said pixel arrays to be at interval of the integral times of the torque ripple of the driving source.

Other objectives and advantages besides those discussed above will be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the embodiments will be described in accordance with the present invention.

(First Embodiment)

Figure 1:
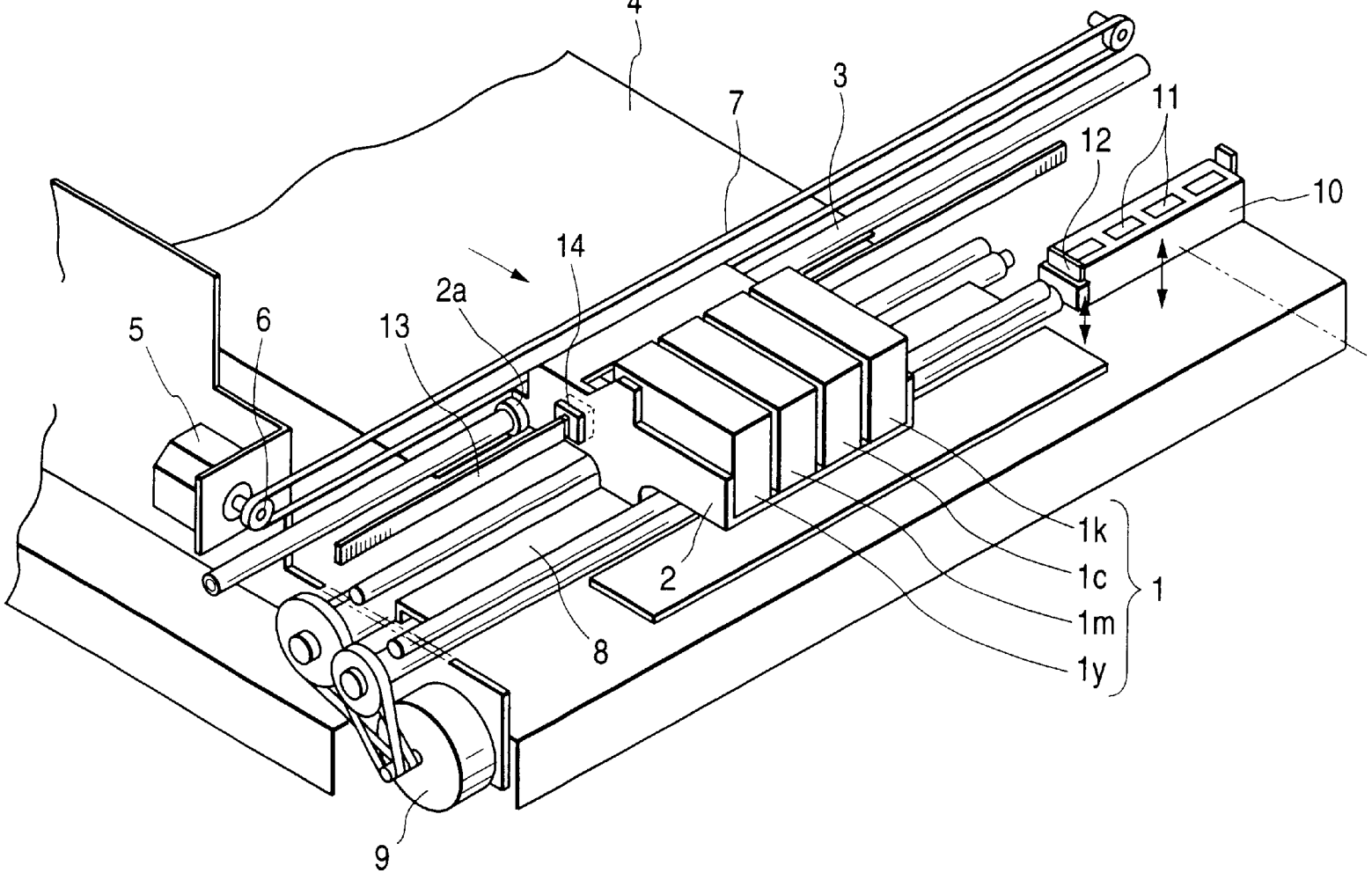
FIG. 1 is a perspective view which shows a recording apparatus in accordance with a first embodiment of the present invention.

FIG. 1 is a perspective view which shows a recording apparatus in accordance with a first embodiment of the present invention.

The recording apparatus of the present embodiment is an ink jet recording apparatus provided with the recording heads 1 of the so-called ink jet recording type. Of the ink jet recording types, each of the recording heads 1 is, particularly, provided with means for generating thermal energy as the energy which is utilized for discharging ink. Then, with the method whereby to generate the change of states of ink by the application of the thermal energy, it is achieved to form highly precise images recorded in high density. The recording heads 1 are provided with an yellow recording head 1y, a magenta recording head 1m, a cyan recording head 1c, and a black recording head 1k, namely, four color recording heads in total. Then, each of the recording heads 1y, 1m, 1c, and 1k is mounted on the carriage 2 in a state where each of them is arranged in the longitudinal direction of the guide shaft 3, that is, in the traveling direction of the carriage 2.

In FIG. 1, each of the recording heads 1 is mounted on the carriage 2 in a posture that the head can discharge ink downward in FIG. 1. Then, the heads discharges ink droplets, while the bearing portion 2*a* of the carriage 2 travels along the guide shaft 3 of the carriage 2, hence forming images on the recording medium 4, such as a recording sheet, per scanning portion. In this respect, the reciprocal movement of the carriage 2 is made along the guide shaft 3 through the timing belt 7 by means of the pulley 6 which rotates by the transmission of the driving power from the carriage motor 5.

When the e recording heads 1 complete the recording of one scanning portion, the recording heads 1 suspend the recording operation. Then, the feed motor 9 is driven to carry the recording medium 4 positioned on the platen 8 in a specific amount in the direction orthogonal to the traveling direction of the carriage 2. Then, the carriage 2 again travels along the guide shaft 3 to form images for the next one scanning portion. With the re petition of these operations, images are recorded on the entire area of the recording medium 4.

On the right side of the recording apparatus main body in FIG. 1, the recovery equipment 10 is arranged to operate recovery in order to keep the condition of ink discharges of the recording heads 1 appropriately. For the recovery equipment 10, there are provided the cap 11 to cover the recording heads 1; the wiper 12 to wipe off the ink discharge surfaces of the recording heads 1; and a suction pump (not shown) to suck ink from the ink discharge nozzles of the recording heads 1.

Also, for the recording apparatus of the present embodiment, the encoder scale 13 and the encoder head 14 are arranged to detect the traveling speed of the carriage 2. The structure is then arranged to execute the feedback control of the carriage motor 5 when it is driven. Also, the encoder head 14 reads the positional information of the encoder scale 13 to control the timing of the ink discharges from the recording heads 1.

Figure 2:
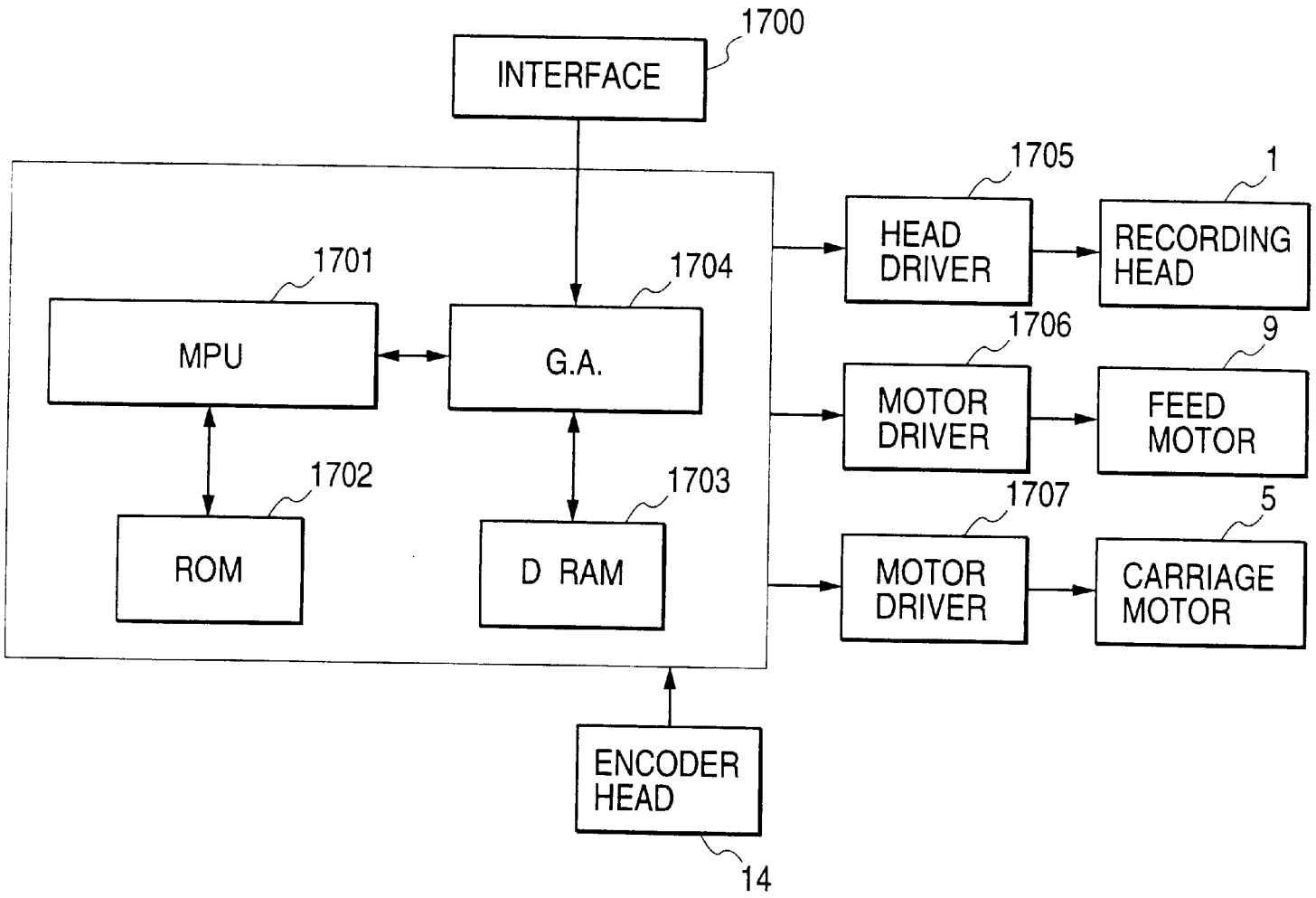
FIG. 2 is block diagram which shows the structure of the control circuit of the recording apparatus represented in FIG. 1.

FIG. 2 is a block diagram which shows the structure of the control circuit arranged for the recording apparatus represented in FIG. 1.

In FIG. 2, a reference numeral 1700 designates the interface used for the recording signal input; 1701, an MPU; 1702, the ROM that stores the control program to be executed by the MPU 1701; 1703, the DRAM that stores various data; and also, 1704, the gate array (G.A.) that controls the supply of recording data to the recording heads 1. The gate array 1704 also controls the transfer of data between the interface 1700, the MPU 1701, and the RAM 1703. A reference numeral 1705 designates the head driver that drives the recording heads 1; 1706, the motor driver that drives the feed motor 9; and 1707, the motor driver that drives the carriage motor 5. Also, a reference numeral 14 designates the encoder head shown in FIG. 1.

Now, the description will be made of the control circuit thus structured. When the interface 1700 receives recording signals, the recording signals converted to the recording data between the gate array 1704 and the MPU 1701 for printing use. Then, the motor drivers 1706 and 1707 are driven, and the recording heads 1 are driven at the same time in accordance with the recording data transmitted to the head driver 1705, thus executing the recording operation. In this case, at the same time that the motor driver 1707 for use of the carriage motor 5 is controlled by the feedback which is derived from the signals received from the encoder 14, the recording heads 1 are driven at the discharge timing set by the signals received from the encoder 14.

Figure 3:
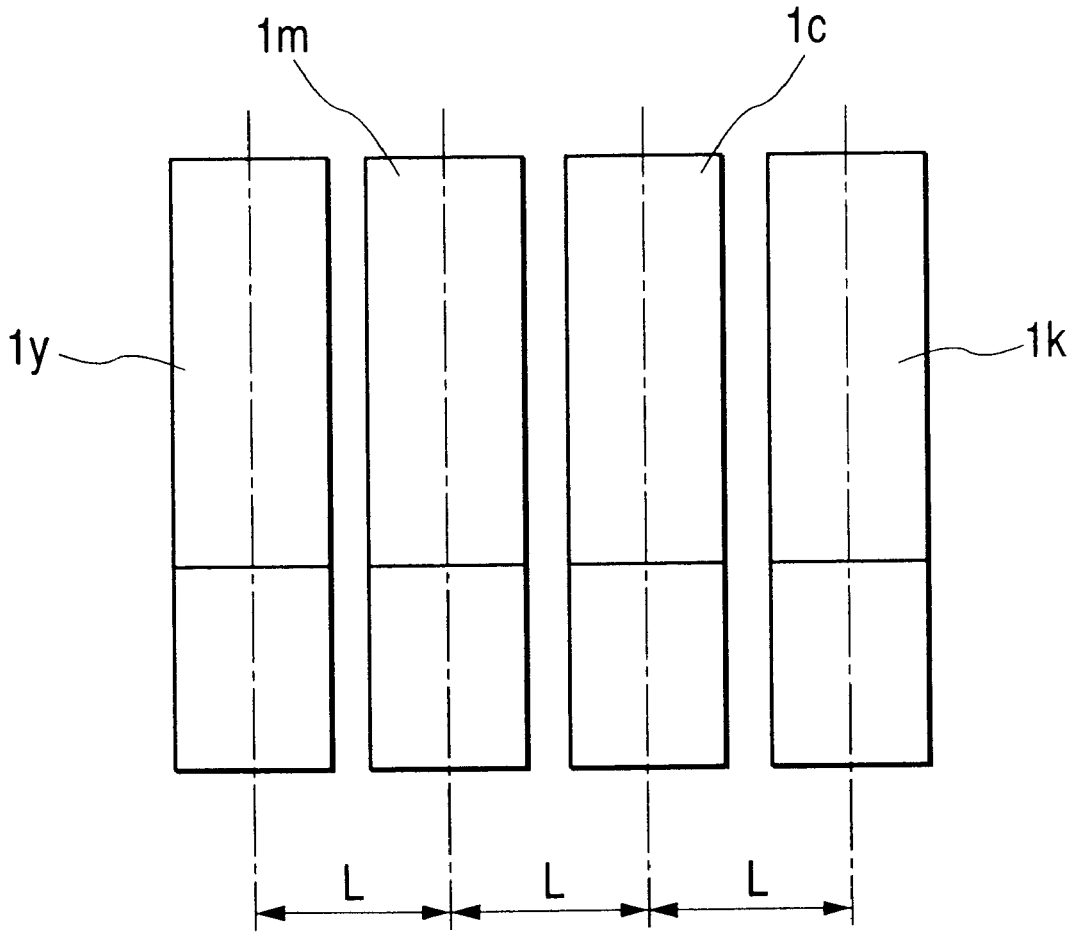
FIG. 3 is a view which shows the arrangement pitches between the recording heads each used for different color represented in FIG. 1.

FIG. 3 is a view which shows the arrangement pitches between the nozzle arrays themselves for the recording heads each used for different color represented in FIG. 1.

As described above, the recording heads 1 of the present embodiment are provided with the yellow recording head 1y, the magenta recording head 1m, the cyan recording head 1c, and the black recording head 1k. The nozzle arrays of the recording heads each used for different color are arranged at intervals L to each other. The recording heads of each color are provided with a plurality of nozzles (not shown) to discharge ink droplets from the discharge ports as the pixels with which to record images on the recording medium 4 (see FIG. 1). These plural nozzles are arrange in one line to form the nozzle array. With the recording heads of each color thus arranged, each of the nozzle arrays provided for the recording heads is arranged in parallel to each other.

Figure 4:
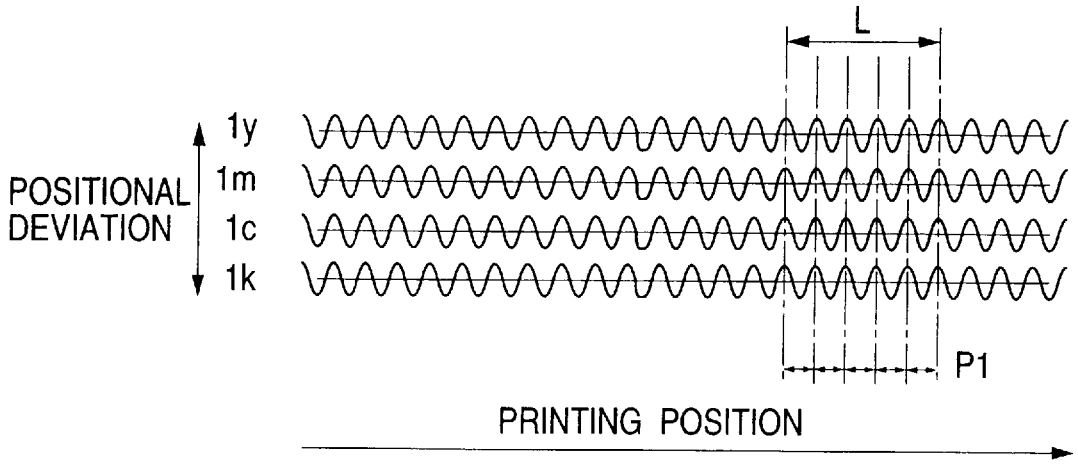
FIG. 4 is a view which shows each width of the positional deviations of the recording heads each used for different color when the carriage moves at a speed $v_1$ with the recording heads mounted thereon.

FIG. 4 is a view which shows each width of the positional deviations of the recording heads each used for different color when the carriage 2 moves at a speed $v_1$ with the recording heads 1 mounted thereon. The carriage 2 generates vibrations at the cycle determined by the vibration frequency f inherent in the carriage driving system of the recording apparatus of the present embodiment. Then, the positional deviation is repeated at this cycle for the recording heads each used for different color, respectively.

In FIG. 4, the axis of abscissa indicates the printing positions, that is, the positions of the recording heads each used for different color when the heads move. Then, the pitch (distance) of the positional deviation is indicated by the reference mark $P_1$ in accordance with the cycle of the positional deviation. The pitch $P_1$ is determined by the speed $v_1$ of the carriage 2 divided by the vibration frequency f inherent in the carriage driving system. In accordance with the present embodiment, the each interval L between nozzles themselves of the recording heads each used for different color is five integral times the pitch $P_1$. Then, the structure is arranged so that each phase of the positional deviations of the recording heads 1y, 1m, 1c, and 1k is in agreement with each other as to the recording position on the recording medium 4.

Figure 5:
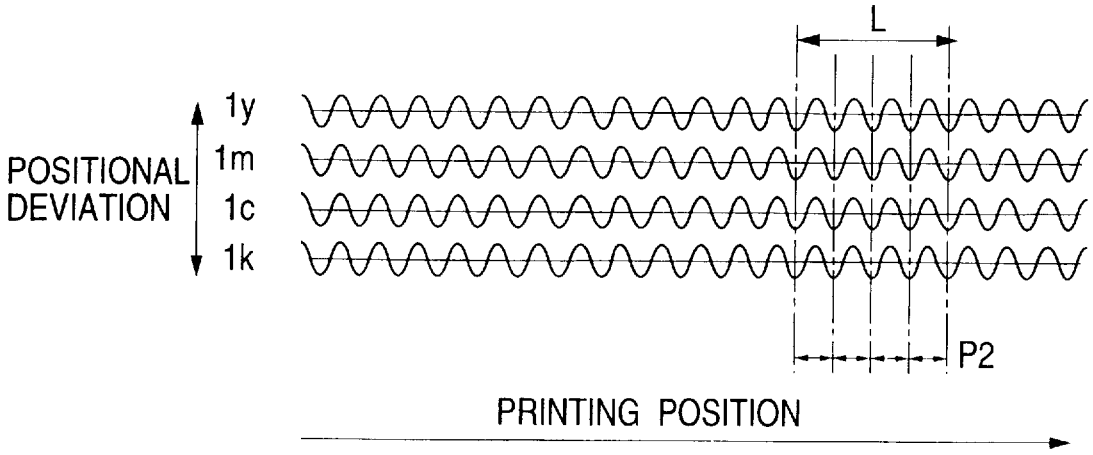
FIG. 5 is a view which shows each width of the positional deviations of the recording heads each used for different color when the carriage moves at a speed $v_2$ with the recording heads mounted thereon.

FIG. 5 is a view which shows the width of the recording heads each used for different color when the carriage 2 travels at the speed $v_2$ with the recording heads 1 mounted thereon.

Since the speed $v_2$ is the one 5/4 times the speed $V_1$, the pitch (distance) $P_2$ of the positional deviation which is determined by the (the speed $v_2$ of the carriage 2)/(the vibration frequency f inherent in the carriage driving system) becomes 5/4 times the aforesaid pitch $P_1$. Therefore, in accordance with the example shown in FIG. 5, the interval L between the nozzle arrays themselves of the recording heads each used for different color also becomes four integral times the pitch $P_2$. Consequently, the structure is arranged so that each phase of the positional deviations of the recording heads 1y, 1m, 1c, and 1k are in agreement with each other with respect to the recording positions on the recording medium 4 as in the case described in conjunction with FIG. 4.

As described above, if the vibration frequency f inherent in the carriage driving system is determined in advance, it becomes possible to make the interval L the integral times (the speed v)/(inherent vibration frequency f) by changing the interval L between the nozzle arrays themselves of the recording heads each used for different color or the traveling speed v of the carriage 2 appropriately. As a result, for the recording apparatus thus structured, the integral times of the pitch (distance) P of the positional deviation is arranged to be the interval L between the nozzle arrays themselves of the recording heads each used for different color, and then, each phase of positional deviations of the recording heads 1y, 1m, 1c, and 1k is in agreement with each other with respect to the recording positions on the recording medium 4. As a result, it becomes possible to suppress the occurrence of image unevenness and color deviations when overlaying each of the recorded images which is formed by the recording heads each used for different color.

(Second Embodiment)

Figure 6:
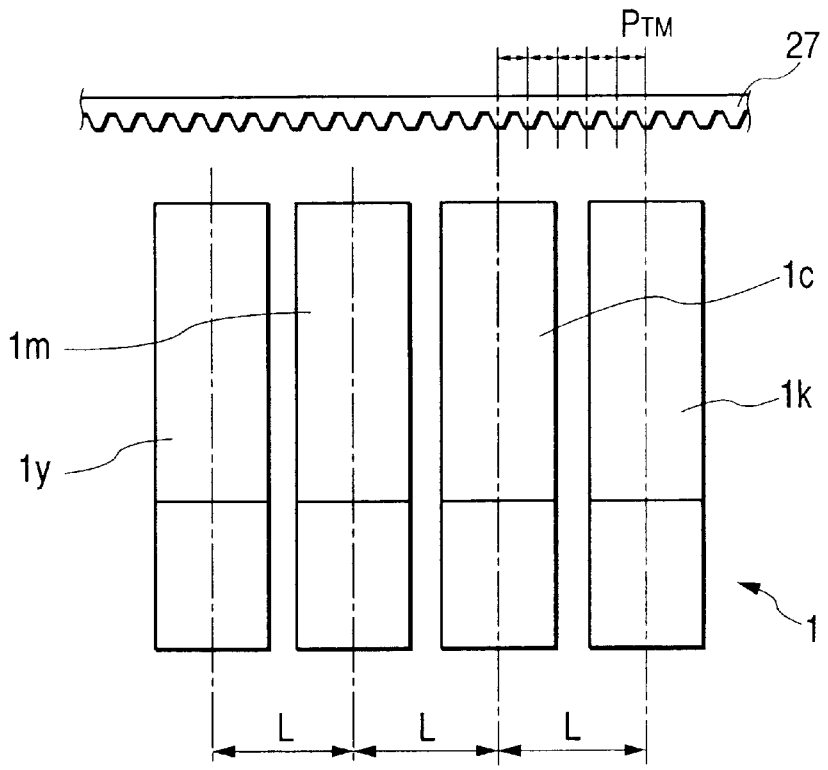
FIG. 6 is a view which shows the recording heads and the timing belt of the recording apparatus in accordance with a second embodiment of the present invention.

FIG. 6 is a view which shows the recording heads and the timing belt of a recording apparatus in accordance with a second embodiment of the present invention.

As shown in FIG. 6, the timing belt 27 of the present embodiment is formed to provide the tooth intervals $P_{TM}$. Any other structures of the recording apparatus than this arrangement are the same as those of the recording apparatus shown in FIG. 1. Therefore, the detailed description will be omitted.

Figure 7:
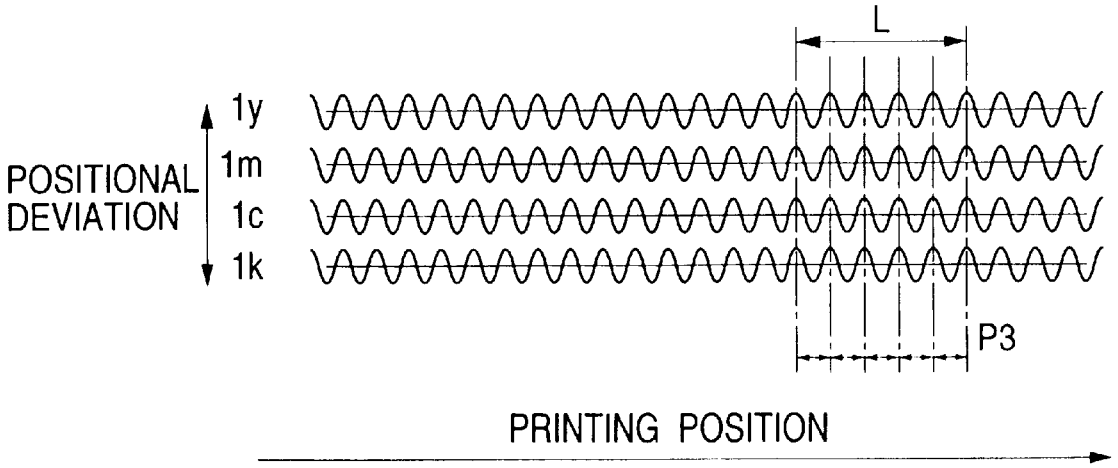
FIG. 7 is a view which shows each width of the positional deviations of the recording heads each used for different color when the carriage having the recording heads mounted thereon moves through the timing belt represented in FIG. 6.

FIG. 7 is a view which shows each width of the positional deviations of the recording heads each used for different color when the carriage 2 having the recording heads 1 mounted thereon moves through the timing belt 27 represented in FIG. 6. The carriage 2 generates minute vibrations in a cycle corresponding to the tooth intervals $P_{TM}$ of the timing belt 27. The positional deviations are repeated for each of the recording heads of different colors in accordance with such cycle.

In FIG. 7, the axis of abscissa indicates the printing positions, that is, the positions of the recording heads each used for different color when the heads move. Then, the pitch (distance) of the positional deviation is indicated by the reference mark $P_3$ for each recording head used for different color. The pitch $P_3$ is determined by the tooth interval $P_{TM}$ of the timing belt 27. In accordance with the present embodiment, the each interval L between nozzles themselves of the recording heads each used for different color is five integral times the pitch $P_3$. Then, the structure is arranged so that each phase of the positional deviations of the recording heads 1y, 1m, 1c, and 1k is in agreement with each other as to the recording position on the recording medium 4.

As described above, for the recording apparatus of the present embodiment, too, it is structured to arrange the integral times of the pitch (distance) P of the positional deviation to be the interval L between the nozzle arrays themselves of the recording heads each used for different color, and then, each phase of positional deviations of the recording heads 1y, 1m, 1c, and 1k is in agreement with each other with respect to the recording positions on the recording medium 4. As a result, it becomes possible to suppress the occurrence of image unevenness and color deviations when overlaying each of the recorded images which is formed by the recording heads each used for different color.

(Third Embodiment)

Figure 8:
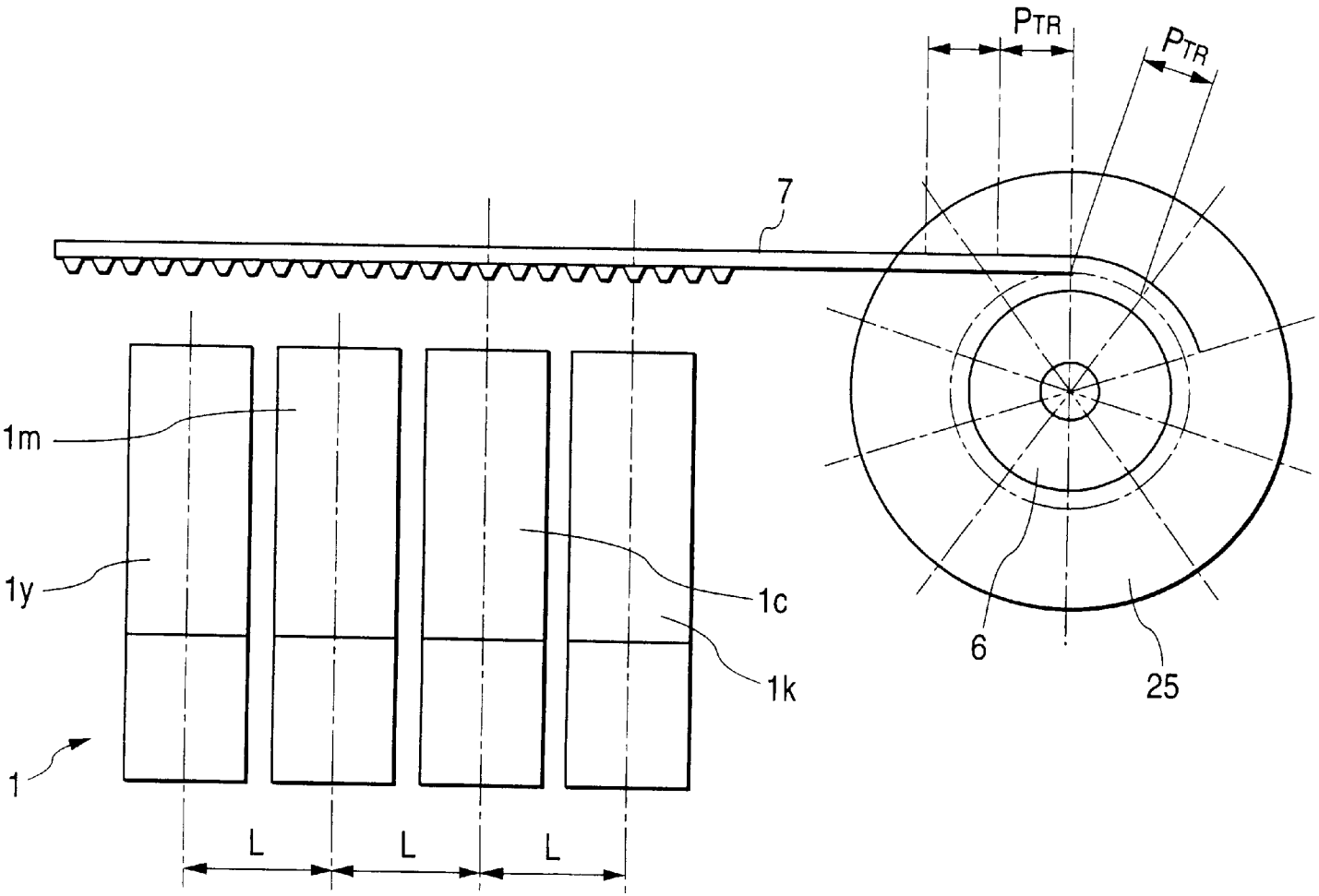
FIG. 8 is a view shows the recording heads, a carriage motor, a pulley, and a timing belt of the recording apparatus in accordance with a third embodiment of the present invention.

FIG. 8 is a view shows the recording heads, a carriage motor, a pulley, and a timing belt of the recording apparatus in accordance with a third embodiment of the present invention.

As shown in FIG. 8, the carriage motor 35 of the present embodiment is provided with the torque ripple $P_{TR}$ of 10 cycle portions per round when it is driven. The torque ripple is transmitted to the carriage 2 as vibrations through the pulley 6. The vibrations thus transmitted cause the carriage 2 to vibrate minutely in accordance with the cycles of the torque ripple $P_{TR}$.

Figure 9:
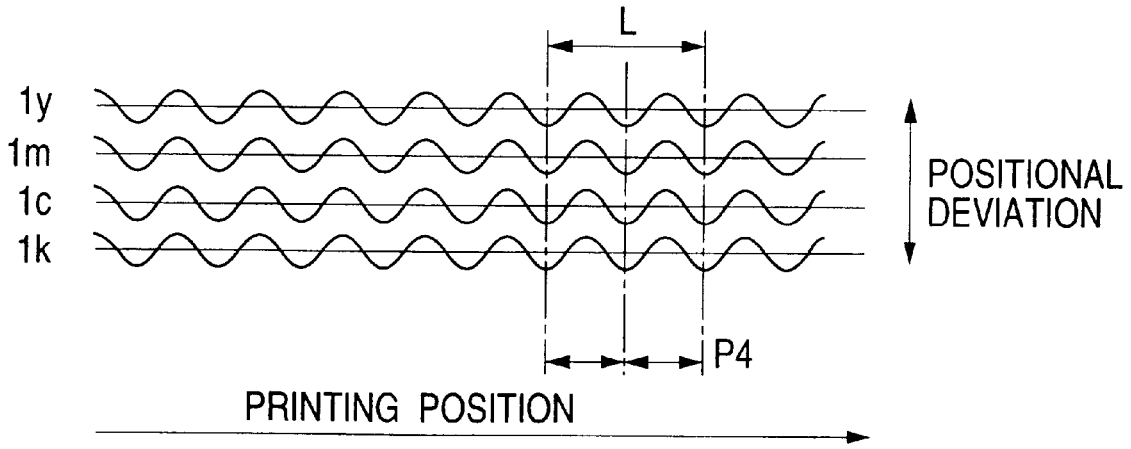
FIG. 9 is a view which shows each width of the positional deviations of the recording heads each used for different color when the carriage having them mounted thereon moves by means of the carriage motor shown in FIG. 8 serving as the driving source thereof.

FIG. 9 is a view which shows each width of the positional deviations of the recording heads 1 each used for different color when the carriage 2 having them mounted thereon moves by means of the carriage motor 25 shown in FIG. 8 serving as the driving source thereof. The carriage 2 generates the minute vibrations in accordance with the torque ripple $P_{TR}$ of the carriage motor 25, thus the positional deviations being repeated for the recording heads each used for different color corresponding to such cycle alike.

In FIG. 9, the axis of abscissa indicates the printing positions, that is, the positions of the recording heads each used for different color when the heads move. Then, the pitch (distance) of the positional deviation is indicated by the reference mark $P_4$ for each recording head used for different color. The pitch $P_4$ is determined by the intervals of the torque ripple $P_{TR}$ of the carriage motor 25. In accordance with the present embodiment, the each interval L between nozzles themselves of the recording heads each used for different color is two integral times the pitch $P_4$. Then, the structure is arranged so that each phase of the positional deviations of the recording heads 1y, 1m, 1c, and 1k is in agreement with each other.

As described above, for the recording apparatus of the present embodiment, too, it is structured to arrange the integral times of the pitch (distance) P of the positional deviation to be the interval L between the nozzle arrays themselves of the recording heads each used for different color, and then, each phase of positional deviations of the recording heads 1y, 1m, 1c, and 1k is in agreement with each other with respect to the recording positions on the recording medium 4. As a result, it becomes possible to suppress the occurrence of image unevenness and color deviations when overlaying each of the recorded images which is formed by the recording heads each used for different color.

As has been described above, in accordance with each of the embodiments, the recording apparatus is structured to arrange each interval of the pixel arrays themselves adjacent to each other to be the interval which is the integral times the v/f, provided that the traveling speed of the carriage is defined as v, and that the vibration frequency inherent in the driving system of the carriage which enables the carriage to move is defined as f, or the recording apparatus is structured to arrange the interval of each of the pixel arrays themselves adjacent to each other to be the interval which is integral times the tooth interval of the timing belt that transmits the driving power of the driving source to the carriage or to arrange the interval of each of the pixel arrays themselves adjacent to each other to be the interval which is integral times the torque ripple interval of the driving source that enables the carriage to travel. Then, the phase of each positional deviation of each pixel array is in agreement with each other with respect to each recording position on the recording medium. In this manner, it becomes possible to suppress the minute vibrations that may be generated by the carriage. As a result, when each of the recorded images formed by each pixel array is overlaid, the image unevenness and the color deviations are suppressed to make it possible to record images in high quality.

What is claimed is:

1. A recording apparatus provided with a carriage capable of traveling with recording means mounted thereon to record images on a recording medium, comprising:

carriage traveling means for enabling said carriage to travel at a traveling speed v in a constant speed condition, said carriage traveling means driving said carriage by a carriage driving system having an inherent vibration frequency f; and a plurality of pixel arrays formed by plural pixels for each of recording means arranged in parallel with each other, each of said pixel arrays themselves adjacent to each other being arranged for said pixel arrays to be at interval of the integral times of v/f.

2. A recording apparatus according to claim 1, wherein said recording medium is carried in the direction orthogonal to the traveling direction of said carriage.

3. A recording apparatus according to claim 1 or claim 2, wherein said pixels are ink discharge ports for discharging ink, and said recording means is an ink jet recording head for recording on said recording medium by discharging ink from said ink discharge ports.

4. A recording apparatus according to claim 1 or claim 2, wherein said pixels are ink discharge ports for discharging ink, and said recording means is an ink jet recording head for recording on said recording medium by discharging ink from said ink discharge ports by the utilization of generated thermal energy.

5. A recording apparatus provided with a carriage capable of traveling with recording means mounted thereon for recording images on a recording medium, comprising:

a timing belt for transmitting to said carriage the driving power of a driving source for the carriage to travel, said timing belt being provided with a plurality of tooth portions for transmitting said driving power; and a plurality of pixel arrays formed by plural pixels for each of recording means arranged in parallel with each other, each of said pixel arrays themselves adjacent to each other being arranged for said pixel arrays to be at interval of the integral times of the tooth portions of said timing belt.

6. A recording apparatus according to claim 5, wherein said recording medium is carried in the direction orthogonal to the traveling direction of said carriage.

7. A recording apparatus according to claim 5 or claim 6, wherein said pixels are ink discharge ports for discharging ink, and said recording means is an ink jet recording head for recording on said recording medium by discharging ink from said ink discharge ports.

8. A recording apparatus according to claim 5 or claim 6, wherein said pixels are ink discharge ports for discharging ink, and said recording means is an ink jet recording head for recording on said recording medium by discharging ink from said ink discharge ports by the utilization of generated thermal energy.

9. A recording apparatus provided with a carriage capable of traveling with recording means mounted thereon for recording images on a recording medium, comprising:

a driving source for said carriage to travel, said driving source being provided with torque ripple; and a plurality of pixel arrays formed by plural pixels for each of recording means arranged in parallel with each other, each of said pixel arrays themselves adjacent to each other being arranged for said pixel arrays to be at interval of the integral times of the torque ripple of said driving source.

10. A recording apparatus according to claim 9, wherein said recording medium is carried in the direction orthogonal to the traveling direction of said carriage.

11. A recording apparatus according to claim 9 or claim 10, wherein said pixels are ink discharge ports for discharging ink, and said recording means is an ink jet recording head for recording on said recording medium by discharging ink from said ink discharge ports.

12. A recording apparatus according to claim 9 or claim 10, wherein said pixels are ink discharge ports for discharging ink, and said recording means is an ink jet recording head for recording on said recording medium by discharging ink from said ink discharge ports by the utilization of generated thermal energy.

* * * * *

UNITED STATES PATENT AND TRADEMARK OFFICE

CERTIFICATE OF CORRECTION

PATENT NO. : 6,299,282 B1
DATED : October 9, 2001
INVENTOR(S) : Soichi Hiramatsu It is certified that error appears in the above-identified patent and that said Letters Patent is hereby corrected as shown below:

Column 3,
Line 52, "shows" should read -- which shows --.

Column 4,
Line 14, "an" should read -- a --;
Line 24, "discharges" should read -- discharge --;
Line 33, "e" should be deleted; and
Line 40, "re petition" should read -- repetition --.

Column 5,
Line 11, "converted" should read -- are converted --;
Line 34, "arrange" should read -- arranged --; and
Line 66, "speed $V_1$," should read -- speed $v_1$, --.

Column 7,
Line 10, "shows" should read -- which shows --.

Signed and Sealed this

Twenty-sixth Day of March, 2002

*Attest:*

*Attesting Officer*

JAMES E. ROGAN
*Director of the United States Patent and Trademark Office*